US012397942B2

(12) United States Patent
Bijlsma

(10) Patent No.: US 12,397,942 B2
(45) Date of Patent: Aug. 26, 2025

(54) DEVICE FOR PACKAGING OF MEDICINE-UNITS

(71) Applicant: DD Innovations B.V., Liempde (NL)

(72) Inventor: Dennis Raymond Bijlsma, Tuk (NL)

(73) Assignee: DD INNOVATIONS B.V., Liempde (NL)

( * ) Notice: Subject to any disclaimer, the term of this patent is extended or adjusted under 35 U.S.C. 154(b) by 0 days.

(21) Appl. No.: 17/845,051

(22) Filed: Jun. 21, 2022

(65) Prior Publication Data

US 2023/0017677 A1 Jan. 19, 2023

(30) Foreign Application Priority Data

Jul. 16, 2021 (NL) ..... 2028767

(51) Int. Cl.

| | |
|---|---|
| ***B65B 9/093*** | (2012.01) |
| ***B65B 37/02*** | (2006.01) |
| ***B65B 41/16*** | (2006.01) |
| ***B65B 57/10*** | (2006.01) |

(52) U.S. Cl.

CPC ..... *B65B 9/093* (2013.01); *B65B 37/02* (2013.01); *B65B 41/16* (2013.01); *B65B 57/10* (2013.01)

(58) Field of Classification Search

CPC ..... B65B 9/093; B65B 37/02; B65B 41/16; B65B 57/10

USPC ..... 53/152

See application file for complete search history.

(56) References Cited

U.S. PATENT DOCUMENTS

| | | | | | |
|---|---|---|---|---|---|
| 2,649,673 | A * | 8/1953 | Bartelt | B65B 9/093 | 53/562 |
| 3,394,870 | A * | 7/1968 | Curtis | B65D 77/08 | 493/202 |
| 3,494,482 | A * | 2/1970 | Lense | B65B 35/58 | 198/468.4 |
| 3,553,934 | A * | 1/1971 | Johnson | B65C 11/021 | 493/239 |
| 3,699,746 | A * | 10/1972 | Titchenal | B65B 43/123 | 53/384.1 |
| 4,201,031 | A * | 5/1980 | Wiles | B65B 29/10 | 53/562 |
| 4,216,639 | A * | 8/1980 | Gautier | B65B 9/093 | 53/413 |
| 4,312,171 | A * | 1/1982 | Vadas | B65B 31/041 | 53/512 |
| 4,580,473 | A * | 4/1986 | Seiden | B65B 43/12 | 271/204 |

(Continued)

*Primary Examiner* — Dariush Seif

(74) *Attorney, Agent, or Firm* — The Dobrusin Law Firm, P.C.

(57) ABSTRACT

The invention relates to a device for packaging of medicine-units, comprising a controllable conveyor for conveying a packaging film extending in a longitudinal direction along a path through the device in a direction of conveyance, a first controllable medicine-unit dispensing device positioned at a first location along the path, at least one second controllable medicine-unit dispensing device, positioned at a second location along the path downstream in the conveying direction relative to the first controllable medicine-unit delivery device, a controller, arranged for controlling the conveyor for moving stepwise in the direction of conveyance and simultaneously controlling the first and at least second dispensing device for dispensing a medicine-unit between displacement steps of the conveyor.

14 Claims, 1 Drawing Sheet

(56) References Cited

U.S. PATENT DOCUMENTS 4,611,455 A * 9/1986 Aiuola ..... B29C 66/4312 156/583.1
4,774,797 A * 10/1988 Colamussi ..... B65B 9/087 53/562
5,179,816 A * 1/1993 Wojnicki ..... B65B 43/30 53/562
5,184,724 A * 2/1993 Mayled ..... B65D 73/0071 206/466
5,271,208 A * 12/1993 Christine ..... B65B 5/04 53/436
5,441,345 A * 8/1995 Garvey ..... B65B 9/093 383/906
5,845,463 A * 12/1998 Henaux ..... B65B 43/30 53/550
5,862,653 A * 1/1999 Solano ..... B65B 43/465 53/562
6,395,317 B1 * 5/2002 Singh ..... B65D 81/34 426/123
6,508,173 B1 * 1/2003 Focke ..... B65B 41/18 101/485
7,021,036 B2 * 4/2006 Hiramoto ..... B65B 3/02 53/562
7,219,481 B2 * 5/2007 Buchman ..... B65B 9/087 53/562
7,430,844 B2 * 10/2008 Buchman ..... B65B 9/087 53/139.2
7,950,206 B2 * 5/2011 Knoth ..... B65B 5/103 53/247
8,347,590 B2 * 1/2013 Goto ..... B31B 70/00 53/450
10,336,489 B2 * 7/2019 Riccardi ..... B65B 43/267
10,414,530 B2 * 9/2019 Murray ..... B65B 1/34
10,501,222 B2 * 12/2019 Nakamoto ..... B65G 21/12
10,800,563 B2 * 10/2020 Yoshikane ..... B65B 43/16
2001/0009090 A1 * 7/2001 Todd ..... B29C 66/43121 53/64
2002/0152719 A1 * 10/2002 Kinigakis ..... B65B 61/188 53/133.4
2002/0152720 A1 * 10/2002 Kinigakis ..... B29C 66/849 53/133.4
2002/0152721 A1 * 10/2002 Kinigakis ..... B29C 66/80 53/133.4
2003/0070395 A1 * 4/2003 McMahon ..... B65B 9/04 53/412
2003/0074861 A1 * 4/2003 Thieman ..... B65B 9/20 53/450
2004/0045256 A1 * 3/2004 Kinigakis ..... B29C 66/83221 53/139.2
2004/0074210 A1 * 4/2004 Kinigakis ..... B65B 43/50 53/550
2006/0196152 A1 * 9/2006 Wild ..... B65B 1/36 53/469
2007/0175180 A1 * 8/2007 Buchman ..... B65B 9/087 53/412
2008/0313998 A1 * 12/2008 Ligon ..... B65B 61/065 53/562
2009/0056281 A1 * 3/2009 Murray ..... B65D 75/5883 493/267
2009/0320958 A1 * 12/2009 Matheyka ..... B65B 25/005 141/98
2010/0050570 A1 * 3/2010 Mori ..... B65B 9/093 53/154
2010/0139217 A1 * 6/2010 Fitzgerald Iv ..... B65B 61/20 53/562
2012/0289391 A1 * 11/2012 Murray ..... B65B 1/02 493/227
2013/0025240 A1 * 1/2013 Uebler ..... B65B 43/28 53/384.1
2013/0061556 A1 * 3/2013 Hatsuno ..... B65B 61/26 53/52
2014/0083061 A1 * 3/2014 Ibaraki ..... B65B 3/02 53/558
2014/0182244 A1 * 7/2014 Kawamura ..... B65B 31/048 53/284.7
2014/0250834 A1 * 9/2014 Yoshikane ..... B65B 51/146 141/4
2014/0331603 A1 * 11/2014 Takahashi ..... B65B 1/22 53/110
2014/0331619 A1 * 11/2014 Takahashi ..... B65B 43/16 53/525
2014/0352253 A1 * 12/2014 Yamamoto ..... B29C 66/8224 53/76
2016/0016693 A1 * 1/2016 Yoshikane ..... B65B 43/34 493/186
2016/0304229 A1 * 10/2016 Hellenbrand ..... B65B 9/08
2016/0325866 A1 * 11/2016 Riccardi ..... B65B 7/02
2017/0088298 A1 * 3/2017 McLenithan ..... B65B 41/12
2017/0275035 A1 * 9/2017 Luciano, Jr. ..... B65B 57/10
2018/0118393 A1 * 5/2018 Yoshikane ..... B65B 59/005
2019/0344912 A1 * 11/2019 Takahashi ..... B65B 31/042
2021/0161767 A1 * 6/2021 Holmes ..... G16H 20/13
2022/0402640 A1 * 12/2022 Brakkee ..... B65B 61/007
2023/0017677 A1 * 1/2023 Bijlsma ..... B65B 9/093
2025/0002187 A1 * 1/2025 Jochemsen ..... B65B 41/16

* cited by examiner

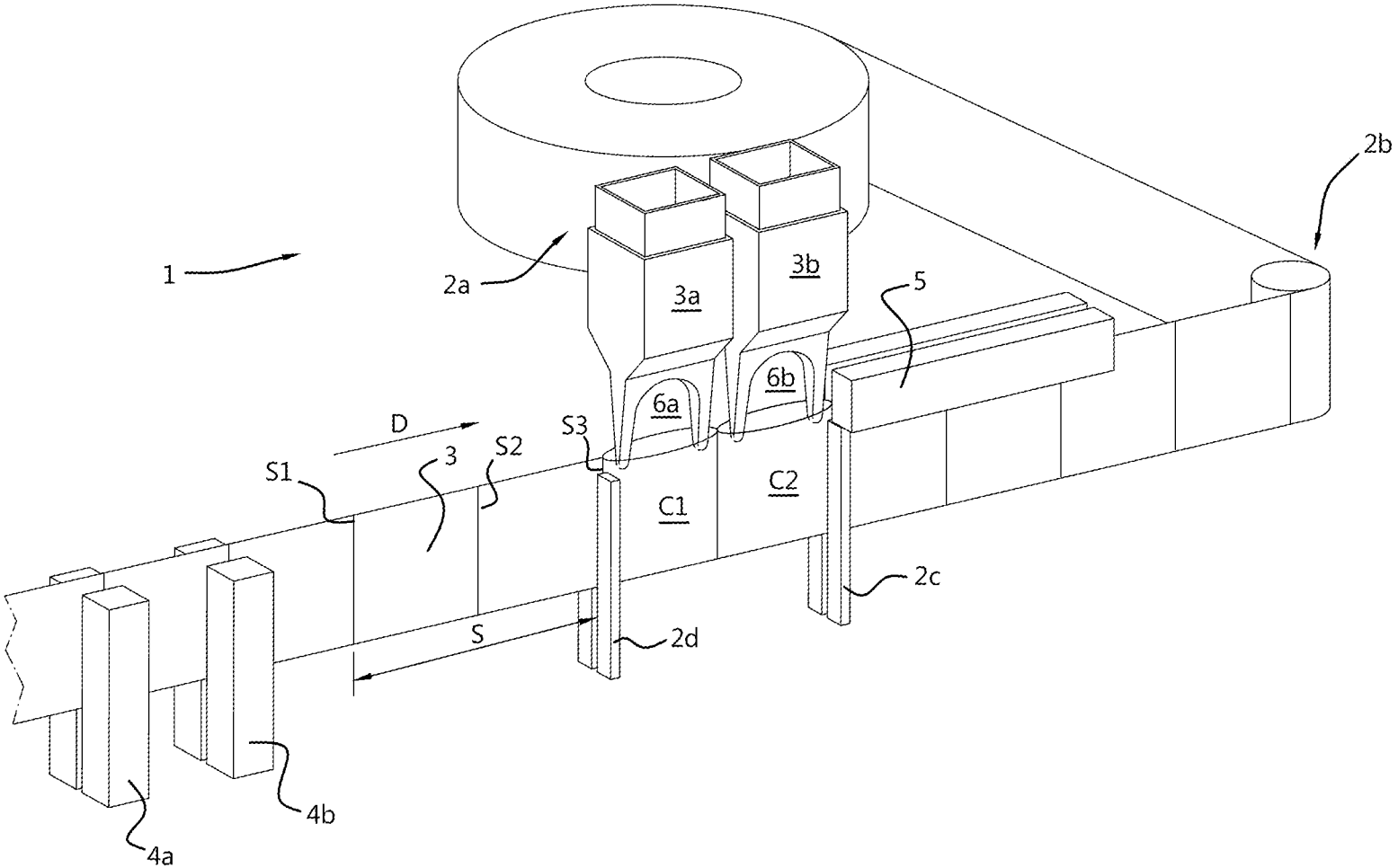
2b
5
2c
3b
6b
C2
3a
6a
C1
2d
S3
2a
S2
S
3
D
S1
4b
1
4a

DEVICE FOR PACKAGING OF MEDICINE-UNITS

The present invention relates to a device for packaging medicine-units. Devices for this purpose are known in the art, for instance from the US patent application US20130061556. This document describes a device for packaging of medicine-units, comprising a controllable conveyor for conveying a packaging film extending in a longitudinal direction along a path through the device in a direction of conveyance and a medicine-unit dispensing device positioned at a location along the path. The packaging film is folded such that it has a V-shaped cross section, with the closed side at the bottom. The device comprises a sealing device for making horizontal seals in the film before the medicine-units are dispensed to the foil and a horizontal seals at the top side after the medicine-units are dispensed.

The above described device works fine in general, but due to ever growing requirements when it comes to speed, the limitations of the constructions become apparent. The speed with which seals can be made is to a large extend dictated by material properties of the film, and processing speed of the medicine-unit dispensing device, which in its turn may amongst other factors be dependent of the falling speeds of the medicine-units from the dispensing device.

The invention thereto proposes a device for packaging of medicine-units, comprising a controllable conveyor for conveying a packaging film extending in a longitudinal direction along a path through the device in a direction of conveyance, a first controllable medicine-unit dispensing device positioned at a first location along the path and at least one second controllable medicine-unit dispensing device, positioned at a second location along the path downstream in the conveying direction relative to the first controllable medicine-unit delivery device, and a controller, arranged for controlling the conveyor for moving stepwise in the direction of conveyance and simultaneously controlling the first and at least second dispensing device for dispensing a medicine-unit between displacement steps of the conveyor.

The device according to the invention provides the advantage of enabling higher throughput speeds, which can in general be the number of medicine-unit dispensing devices times as fast. The medicine unit dispensing devices are or at least may be controlled simultaneously so that multiple medicine units are dispensed at the same time. Normally, these may be different medicine units intended for different packages, and it is also thinkable that multiple (different) medicine units are dispensed into the same package. The film may for that purpose be divided into segments for receiving medicine units, in particular prior to being filled. As described later in this application, this may be done by the device according to the invention, but it is also thinkable that a pre-segmented film is used.

In general for obtaining the desired processing speed, it is not necessary that the medicine-unit dispensing units are positioned adjacent to each other, since positions in between can be filled at an earlier or at a later stage, but it may be found convenient to do so, for obtaining a compact device in general. Therefore, in a preferred embodiment, the first and at least second controllable medicine-unit dispensing devices are arranged at adjacent locations.

As explained above, the device according to the invention may make use of a film that is presented with a V-shaped cross section, so that a compartment with a closed bottom is obtained. In order to make separate compartments (or pockets) for the medicine-unit(s) a patient has to take at a time, there may be at least one vertical sealing device for applying a vertical seal in the film, placed upstream in the direction of conveyance relative to the first controllable dispensing device.

However, again for the sake of speed and in order to prevent the need of an additional stop and start of the conveyor, two (or more) vertical sealing devices for simultaneously applying two (or more) vertical seals in the film may be present. The number of vertical sealing devices or at least vertical sealing locations at which simultaneous sealing takes place, may in particular match the number of medicine-unit dispensing devices.

The controller may further be configured for controlling the vertical sealing devices and the conveyor in conjunction such that a displacement step corresponds to twice the distance between two vertical seals, or in case of multiple medicine-unit dispensing units, the displacement step corresponds to the distance between the number of dispensing units plus one vertical seals.

The device according to the invention may further comprise a horizontal sealing device for applying a horizontal seal in the film, positioned downstream in the direction of conveyance relative to the at least second controllable medicine-unit dispensing device. Such horizontal sealing device may in particular be configured for applying a continuous horizontal seal which extends between three vertical seals in case of two medicine-unit dispensing devices and one more for every extra medicine-unit dispensing unit.

The conveyor may comprise a first gripping device for gripping the film. Such gripping device may be a clamping device, or two rollers disposed at opposite sides of the path. The foil itself may be provided on a reel and also be collected on a reel after filling.

The device according to the invention may comprise a second gripping device, located upstream in the direction of conveyance, adapted for gripping the film simultaneously with the first gripping device wherein the first and the second gripping devices are configured to move toward each other while gripping the film. As a result, the film is compressed in its length direction. With the bottom side of the film being closed by the fold, and the vertical seals being provided either up front or by the device according to the invention, the compression will lead to the opening of the film at its upper side. This facilitates receiving medicine units in the compartments or pockets.

The controllable medicine-unit dispensing devices may be provided with an output funnel, in particular an output funnel for being received between layers of a film, or for being positioned above the location where the film is compressed and opened.

The output funnel may in a preferred embodiment be configured to move toward and from the packaging film, and/or more in particular to move in a vertical direction. The dispensing opening or location of the funnel may then be located in between the layers of the film and in between the horizontal seals, in order to position a medicine-unit in the pocket that is intended to receive it.

The movement into the direction of the film may take place in between the movement of the film and the dispensing of a medicine unit, and the movement in the opposite direction may take place after dispensing the medicine unit.

It should be noted that the feature of the movable funnel and the insertion thereof in the pocked provided in the film may be applied in general to a device for packaging of medicine-units. As a result, the invention also relates to a device for packaging of medicine-units, comprising a controllable conveyor for conveying a packaging film extending in a longitudinal direction along a path through the device in a direction of conveyance, a controllable medicine-unit dispensing device positioned at a first location along the path, a controller, arranged for controlling the conveyor for moving stepwise in the direction of conveyance and simultaneously controlling the first dispensing device for dispensing a medicine-unit between displacement steps of the conveyor, wherein the dispensing device is provided with an output funnel, in particular an output funnel for being received between layers of a film, and/or in particular wherein the funnel is movable in a direction or with a directional component toward and from the packaging film, and/or more in particular in a vertical direction.

Another aspect of the present invention is a verification system for correctness of the packaged products. Such verification system may comprise first optical registration means such as a camera, arranged upstream of the funnel of the least one controllable medicine-unit dispensing device, wherein the optical registration means are configured for obtaining an optical representation (such as an image) of medication units to be packed. The device according to the invention may be equipped with a movable container for moving the medicine units toward a position where the optical registration means are positioned. The optical registration means may be configured for providing a coloured image and/or an ultraviolet image and/or an infra red image. This way, medicine units having similar colours in the visible range, may still be distinguished.

The verification system may further comprise a controller, which may comprise electronic processing means, for comparing images obtained from the optical registration means with reference data and/or reference images, that are uploaded to the system or obtained by training the system.

A set of medicine-units to be packed may then be checked for the number of units, their size, shape, (visible) colour and any other property that allows to recognize and/or distinguish them.

The controller may determine that the set of medicine-units matches the intended set, or that a mismatch is present. In both cases a second image can be taken and a second comparison can be made. Optionally, the container may be slightly moved between taking the first and the second image, to make sure that the angle under which the picture was taken does not have an impact on the verification. Dependent on the outcome, next steps may be rejection of the medicine units, packing, or for instance to decide that manual inspection is requires. The invention will now be elucidated in more detail, with reference to FIG. 1.

FIG. 1 shows a device 1 for the closed packaging of medicine-units, comprising a controllable conveyor 2*a*, 2*b*, 2*c*, 2*d* for conveying a packaging film 3 extending in a longitudinal direction along a path through the device in a direction of conveyance D. The device comprises a first controllable medicine-unit dispensing device 3*a* positioned at a first location along the path and a second controllable medicine-unit dispensing device 3*b*, positioned at a second location along the path downstream in the conveying direction relative to the first controllable medicine-unit delivery device 3*a*. The device further comprises a controller (not depicted) arranged for controlling the conveyor for moving stepwise in the direction of conveyance. The step length S corresponds to the common length of the number of compartments (C1, C2) that can be filled simultaneously, which is in the depicted case also the number of medicine unit dispensing devices 3*a*, 3*b*, in this case two. The controller is configured for simultaneously controlling the first and at least second dispensing device 3*a*, 3*b* for dispensing a medicine-unit between displacement steps of the conveyor 2*a*, 2*b*, 3*c*, 2*d*.

As visible, in the configuration shown, the first and at least second controllable medicine-unit dispensing devices 3*a*, 3*b* are arranged at adjacent locations.

The device 1 comprises a first vertical sealing device 4*a* for applying a vertical seal in the film 3, placed upstream in the direction of conveyance relative to the first controllable dispensing device 3*a*, and a second vertical sealing device 3*b* for simultaneously applying two vertical seals in the film together with vertical sealing device 3*a*.

The controller is configured for controlling the at least one or two vertical sealing devices and the conveyor in conjunction such that a displacement step S corresponds to twice the distance between two vertical seals s1, s2.

The device 1 further comprises a horizontal sealing device 5 for applying a horizontal seal in the film 3, positioned downstream in the direction of conveyance relative to the at least second controllable medicine-unit dispensing device 3*b*. The horizontal sealing device 5 is configured for applying a continuous horizontal seal which extends between three vertical seals s1, s2, s3. The conveyor 2*a*, 2*b*, 2*c*, 2*d* comprises a first gripping device 2*d* for gripping the film and a second gripping device 2*c*, located upstream in the direction of conveyance D, adapted for gripping the film 3 simultaneously with the first gripping device 2*d* and wherein the first and the second gripping devices are configured to move toward each other while gripping the film.

The controllable medicine-unit dispensing devices 3*a*, 3*b* are provided with output funnels 6*a*, 6*b*, for being received between layers of film 3.

The above example is an example only and does in no way limit the scope of protection as defined in the following claims.

The invention claimed is:

1. A device for packaging of medicine-units, comprising:

a controllable conveyor for conveying a packaging film extending in a longitudinal direction along a path through the device in a direction of conveyance;

a first controllable medicine-unit dispensing device positioned at a first location along the path;

a controller, arranged for:

controlling the controllable conveyor for moving stepwise in the direction of conveyance; and simultaneously controlling the first controllable medicine-unit dispensing device and at least a second controllable medicine-unit dispensing device for dispensing the medicine-unit between displacement steps of the conveyor characterized by:

the at least one second controllable medicine-unit dispensing device, positioned at a second location along the path downstream in the direction of conveyance relative to the first controllable medicine-unit dispensing device;

at least one vertical sealing device for applying a vertical seal in the packaging film, placed upstream in the direction of conveyance relative to the first controllable medicine-unit dispensing device, wherein the controller is configured for controlling the at least one vertical sealing device and the conveyor in conjunction such that the displacement steps correspond to twice a distance between two vertical seals;

a first gripping device for gripping the packaging film; and a second gripping device, located upstream in the direction of conveyance, adapted for gripping the packaging film simultaneously with the first gripping device and wherein the first and the second gripping devices are configured to move toward each other while gripping the packaging film to facilitate opening compartments in the packaging film for receiving the medicine-units;

wherein two of the compartments are located between the first and second gripping devices, and the device is free of any additional gripping device between the first and second gripping devices; and wherein the two compartments remain connected prior to and while being filled by the first and second controllable medicine-unit dispensing devices.

2. The device according to claim 1, wherein the first and at least second controllable medicine-unit dispensing devices are arranged at adjacent locations; and wherein the adjacent locations are situated between the first and second gripping devices.

3. The device according to claim 1, comprising two of the at least one vertical sealing device for simultaneously applying the two vertical seals in the packaging film.

4. The device according to claim 3, wherein the first gripping device is upstream in the direction of conveyance of the first controllable medicine-unit dispensing device and the second gripping device is downstream in the direction of conveyance of the at least one second controllable medicine-unit dispensing device.

5. The device according to claim 1, comprising a horizontal sealing device for applying a horizontal seal in the packaging film, positioned downstream in the direction of conveyance relative to the at least second controllable medicine-unit dispensing device.

6. The device according to claim 5, wherein the horizontal sealing device is configured for applying a continuous horizontal seal which extends between three vertical seals.

7. The device according to claim 1, designed for transporting a folded film in the direction of conveyance, with a folding line directed towards its bottom.

8. The device according to claim 1, wherein the first and/or at least one second controllable medicine-unit dispensing device is provided with an output funnel for being received between layers of the packaging film.

9. The device according to claim 8, wherein the output funnel is configured to move, in a vertical direction, toward and from the packaging film.

10. The device according to claim 9, wherein the controller is configured to let movement into the direction of conveyance of the packaging film take place in between the movement of the packaging film and the dispensing of the medicine units, and/or to let movement in an opposite direction take place after dispensing the medicine units.

11. The device according to claim 8, wherein the output funnel comprises at least one wedge that is received between the layers of the packaging film.

12. The device according to claim 11, wherein the output funnel comprises two opposing wedges that are received between the layers of the packaging film.

13. The device according to claim 1, wherein the packaging film is collected on a reel after filling.

14. The device according to claim 1, further comprising a camera arranged upstream of the first and at least one second controllable medicine-unit dispensing devices, and obtains an optical representation of the medicine-units to be packed.

* * * * *